US007262705B2

(12) United States Patent
Back et al.

(10) Patent No.: US 7,262,705 B2
(45) Date of Patent: Aug. 28, 2007

(54) RECESSED DETECTOR ASSEMBLY FOR DETECTING AND VENTING AIRBORNE SUBSTANCES

(76) Inventors: Denis L. Back, 2128 Alpine Pl., Cincinnati, OH (US) 45206; James E. Routzong, 7 Sea Fox La., Gloucester, MA (US) 01930

( * ) Notice: Subject to any disclaimer, the term of this patent is extended or adjusted under 35 U.S.C. 154(b) by 302 days.

(21) Appl. No.: 10/893,227

(22) Filed: Jul. 19, 2004

(65) Prior Publication Data

US 2005/0035868 A1 Feb. 17, 2005

Related U.S. Application Data

(60) Provisional application No. 60/492,611, filed on Aug. 5, 2003.

(51) Int. Cl.
*G08B 17/10* (2006.01)

(52) U.S. Cl. ..... 340/628; 340/629; 340/630; 454/228

(58) Field of Classification Search ..... 340/628, 340/629, 630, 632, 633, 634; 454/228, 236, 454/342; 236/44 R, 49.1, 49.3
See application file for complete search history.

(56) References Cited

U.S. PATENT DOCUMENTS 4,463,896 A * 8/1984 Schaus ..... 236/49.2
4,805,835 A * 2/1989 Schaus ..... 236/49.3
5,333,418 A 8/1994 Chambers
5,555,455 A 9/1996 McGinley
5,855,510 A * 1/1999 McKenzie ..... 454/342
5,926,098 A * 7/1999 Wiemeyer et al. ..... 340/630
6,053,809 A * 4/2000 Arceneaux ..... 454/228
6,935,570 B2 * 8/2005 Acker, Jr. ..... 236/44 R

* cited by examiner

*Primary Examiner*—Van T. Trieu
(74) *Attorney, Agent, or Firm*—Birch, Stewart, Kolasch & Birch, LLP

(57) ABSTRACT

A recessed detector assembly having the capability to detect and evacuate air laden with airborne substances from within the assembly. The assembly includes a detector frame adapted to be flush mounted into a mounting box mounted in a ceiling or a wall, the frame having exposed vents allowing air containing airborne substances to enter the frame; at least one sensor mounted in the detector frame for sensing one or more of the airborne substances and for exhausting the airborne substances, the at least one sensor generating a signal causing an exhaust fan or a drop down sensor for evacuating the one or more airborne substances to operate when a presence of the one or more of the airborne substances is sensed to exceed predetermined levels. Accordingly, the detector may be promptly reset and an alarm may be promptly turned off when airborne substances in the room drop below the predetermined levels.

18 Claims, 12 Drawing Sheets

CROSS SECTION (SCHEME 1: DROP DOWN SENSOR)

NEW CONSTRUCTION APPLICATION

EXISTING CONSTRUCTION APPLICATION

SCHEME 1: DROP DOWN SENSOR

SCHEME 2: PROJECTED SENSOR

SCHEME 3: FAN EVACUATED SENSOR

FACE OF UNIT (SCHEME 1: DROP DOWN SENSOR)

CROSS SECTION (SCHEME 1: DROP DOWN SENSOR)

FACE OF UNIT (SCHEME 2: PROJECTED SENSOR)

CROSS SECTION (SCHEME 2: PROJECTED SENSOR)

FACE OF UNIT (SCHEME 3: FAN EVACUATED SENSOR)

CROSS SECTION (SCHEME 3: FAN EVACUATED SENSOR)

CROSS SECTION (ATLERNATE HOUSING: EXISTING CONSTRUCTION CONDITION)

RECESSED DETECTOR ASSEMBLY FOR DETECTING AND VENTING AIRBORNE SUBSTANCES

CROSS-REFERENCE TO RELATED APPLICATION

The present application claims priority to Provisional Application No. 60/492,611, filed Aug. 5, 2003, the entire contents of which are hereby incorporated by reference.

BACKGROUND OF THE INVENTION

1. Field of the Invention

The present invention relates to a recessed detector assembly for detecting fire, smoke, carbon monoxide, and other airborne substances, the assembly being equipped to vent or evacuate the substances from the assembly. The invention also relates to a method for detecting smoke and other airborne substances and venting or evacuating the substances from the detector assembly.

2. Description of Background Art

Recessed devices for installing existing smoke detectors are known. See for example, Recessed Smoke Detector, U.S. Pat. No. 5,333,418, and Recessed Smoke Detector, U.S. Pat. No. 5,555,455.

However, there is no known recessed detector apparatus equipped to detect multiple abnormal conditions, such as fire, smoke, carbon monoxide, and other airborne substances.

Nor are these conventional recessed detectors capable of venting or evacuating smoke or other airborne substances from the apparatus. This presents a further problem, since when recessed detectors have no venting or evacuation capability, they will not work effectively when recessed into a ceiling or a wall. Venting or evacuation of smoke and other airborne substances is essential for resetting and clearing the detector for reuse.

Further, recessed housings for conventional smoke detectors have clips and other means for installation. This makes them difficult to install in wiring boxes typically used in new construction of homes and commercial buildings.

SUMMARY AND OBJECTS OF THE INVENTION

The recessed detection assembly of the present invention was conceived and developed to solve the above-described problem.

According to a first aspect of the present invention, a recessed detector assembly is provided which includes a detector frame adapted to be flush mounted into a mounting box mounted in a ceiling or a wall, the frame having exposed vents allowing air containing airborne substances to enter the frame; at least one sensor mounted in the detector frame for sensing one or more of the airborne substances; means or exhausting the airborne substances, the at least one sensor generating a signal causing the means for exhausting the one or more airborne substances to operate when a presence of the one or more of the airborne substances is sensed to exceed predetermined levels.

The recessed smoke detector assembly of the present invention is configured to permit the evacuation of airborne substances in the air within the detector assembly, and thus, will cause an alarm signal to stop when air with any lingering airborne substances drops below the predetermined level.

According to a second aspect of the present invention, a method for detecting airborne substances in a recessed detector assembly is provided which includes the steps of determining when airborne substances in a detector assembly reach a predetermined level; generating a signal to activate an exhaust mechanism; evacuating the airborne substances from the assembly; and stopping the signal activating the exhaust mechanism when the airborne substances have been reduced below the predetermined level.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2(*b*) is a perspective view of the recessed detector assembly, intended for existing construction applications;

FIGS. 2(*c*)-(*e*) illustrate the cover plates for a first, a second, and a third embodiment of the recessed detector assembly of the present invention;

DETAILED DESCRIPTION OF THE PREFERRED EMBODIMENTS

Figure 1:
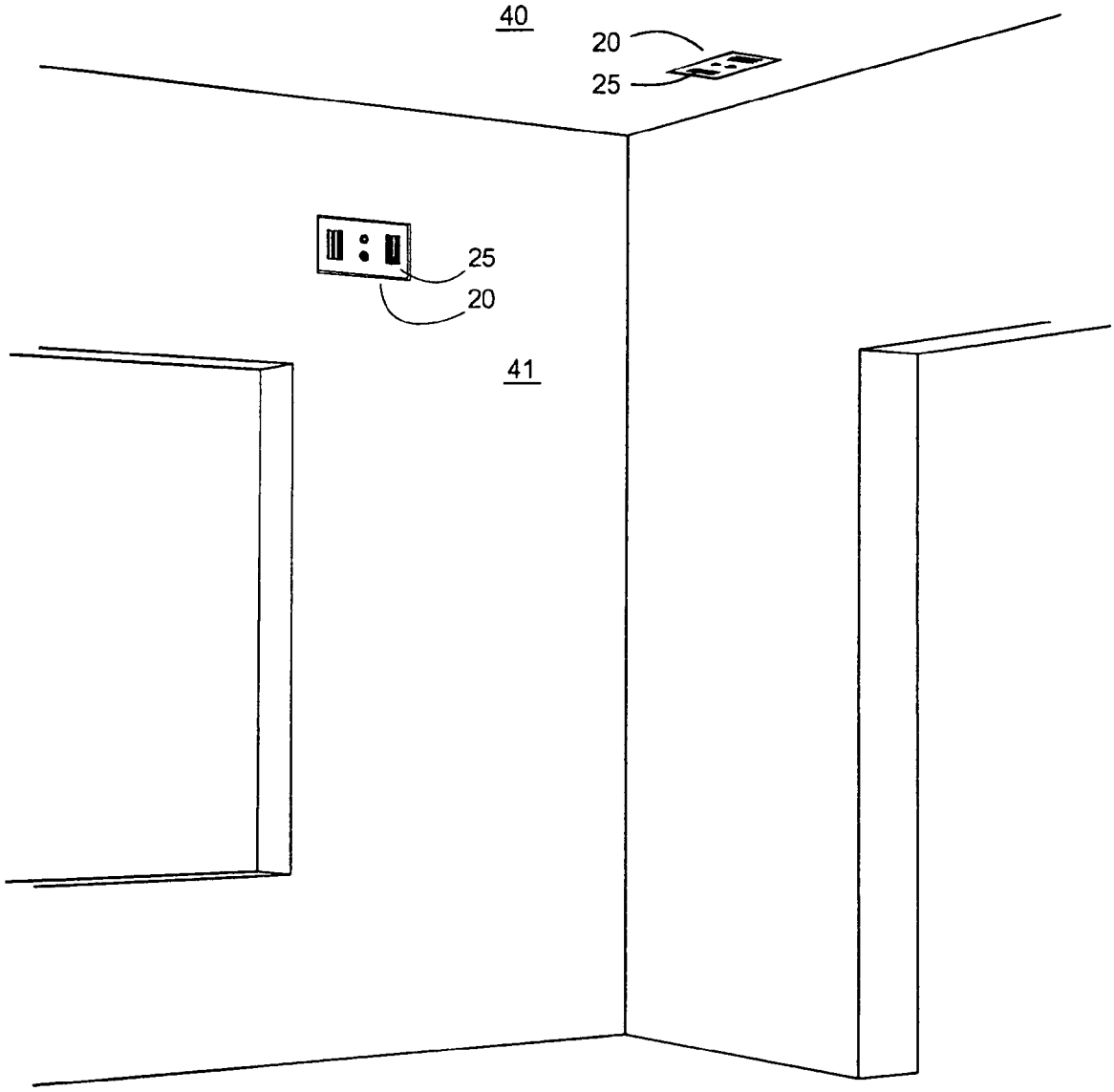
FIG. 1 is perspective view of the recessed detector assembly of the present invention installed in a ceiling and in a wall.
Figure 2A:
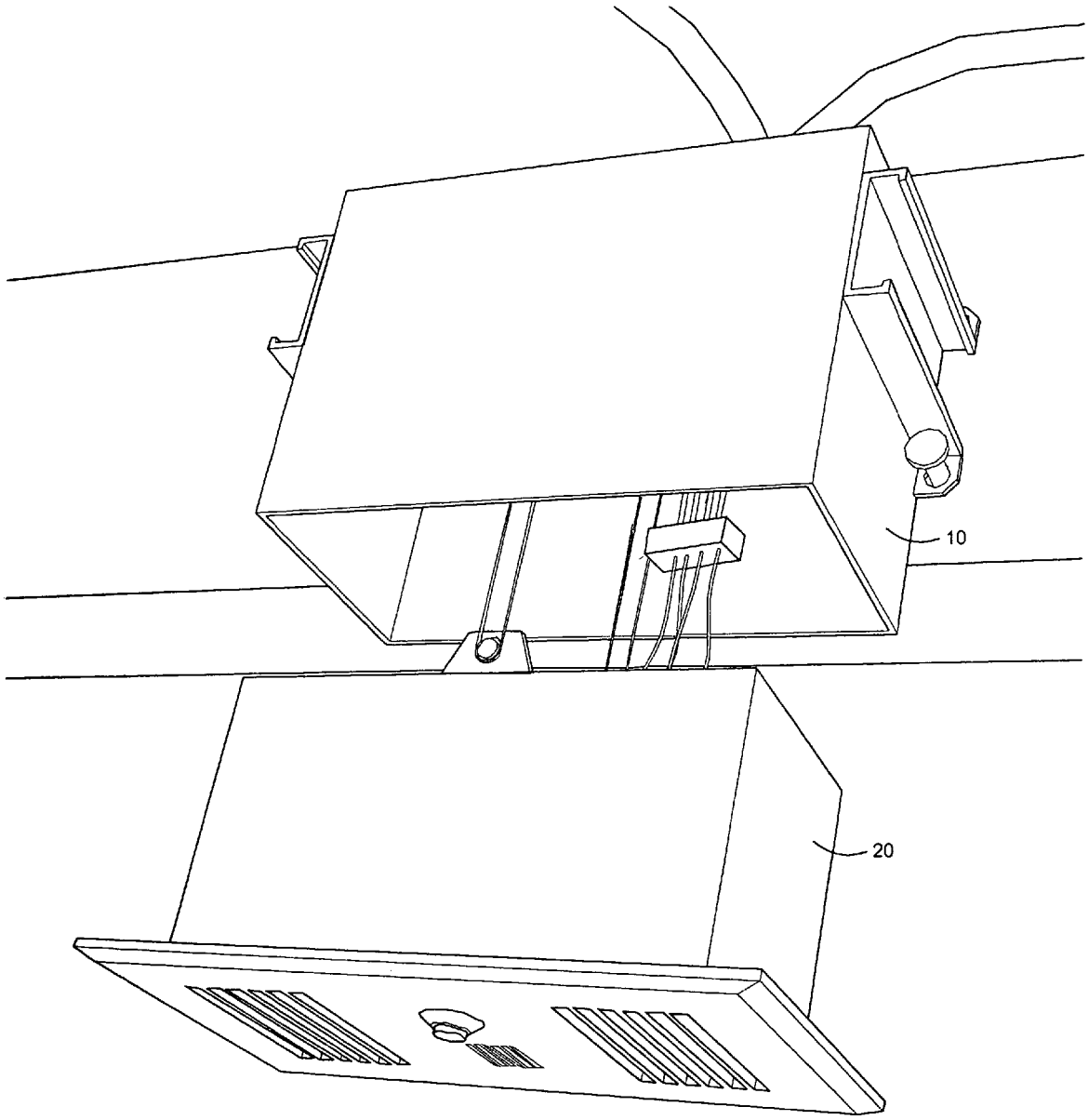
FIG. 2(*a*) is a perspective view of the recessed detector assembly, intended for new construction applications.
Figure 2B:
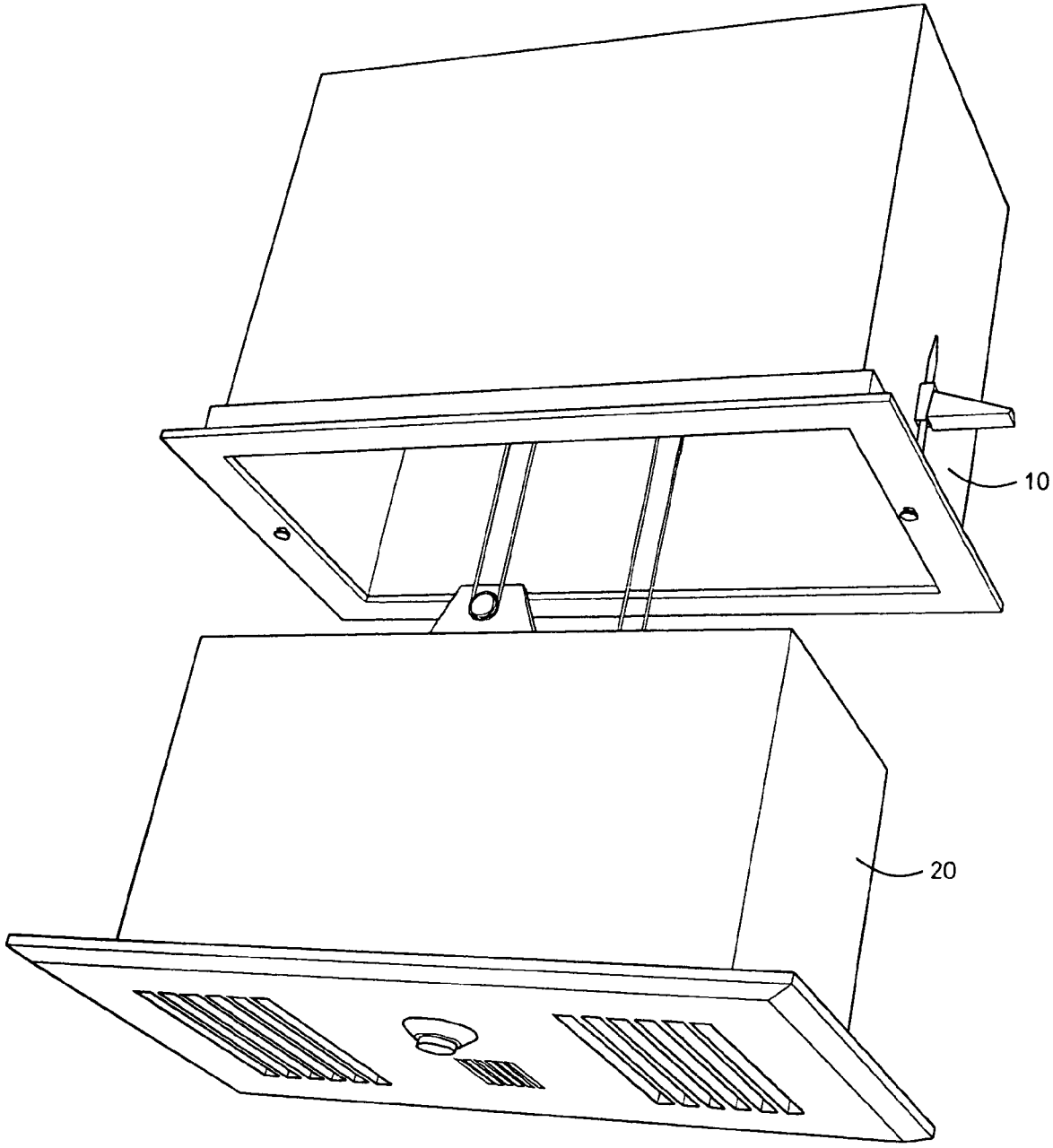
Figure 2C:
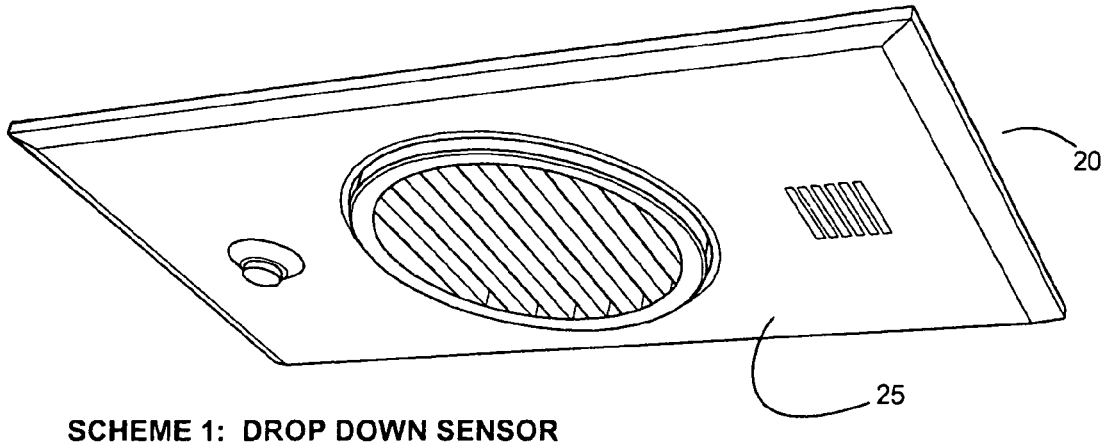
Figure 2D:
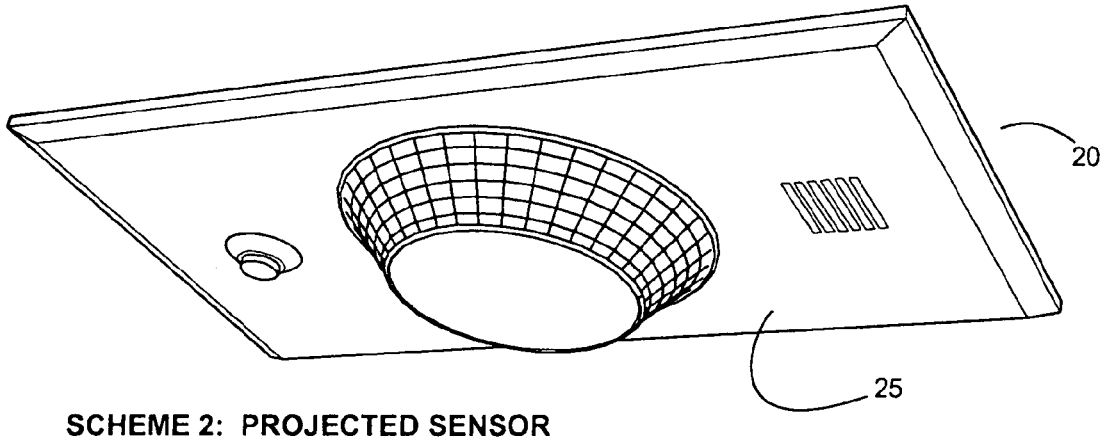
Figure 2E:
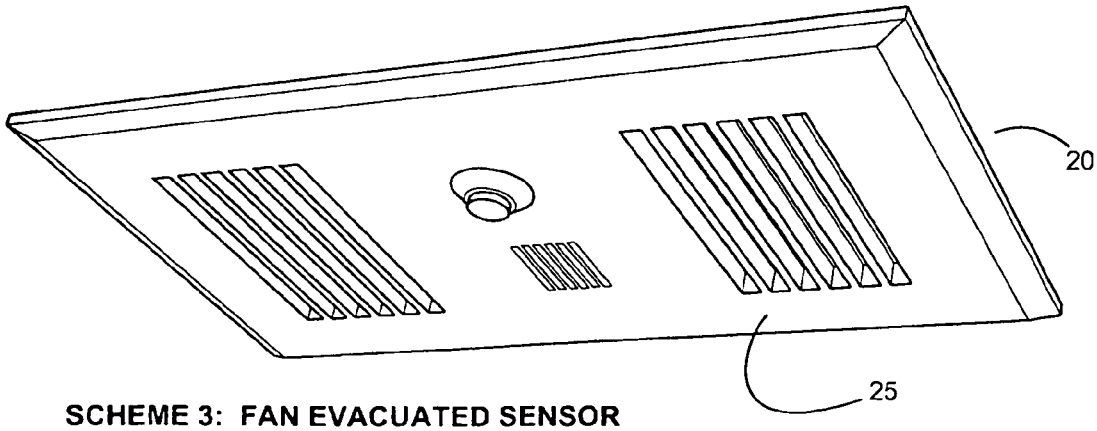

FIG. 1 shows a cover plate 25 of smoke detector assembly 20 installed in a surface of ceiling 40 or a wall 41.

The recessed detector assembly may be installed as part of a new construction installation, or alternatively may installed in an existing structure, and shown in FIGS. 2(*a*) and (*b*), repespectively. In particular, FIG. 2(*a*) is a perspective view of the wiring box 10 and smoke detector assembly 20, intended for new construction application; and FIG. 2(*b*) is a perspective view of the wiring box 10 and the smoke detector assembly 20, intended for existing construction application. FIGS. 2(*c*)-(*e*) illustrate the cover plates for a first, a second, and a third embodiment of the smoke detector assembly of the present invention. These embodiments are described below.

Figure 3:
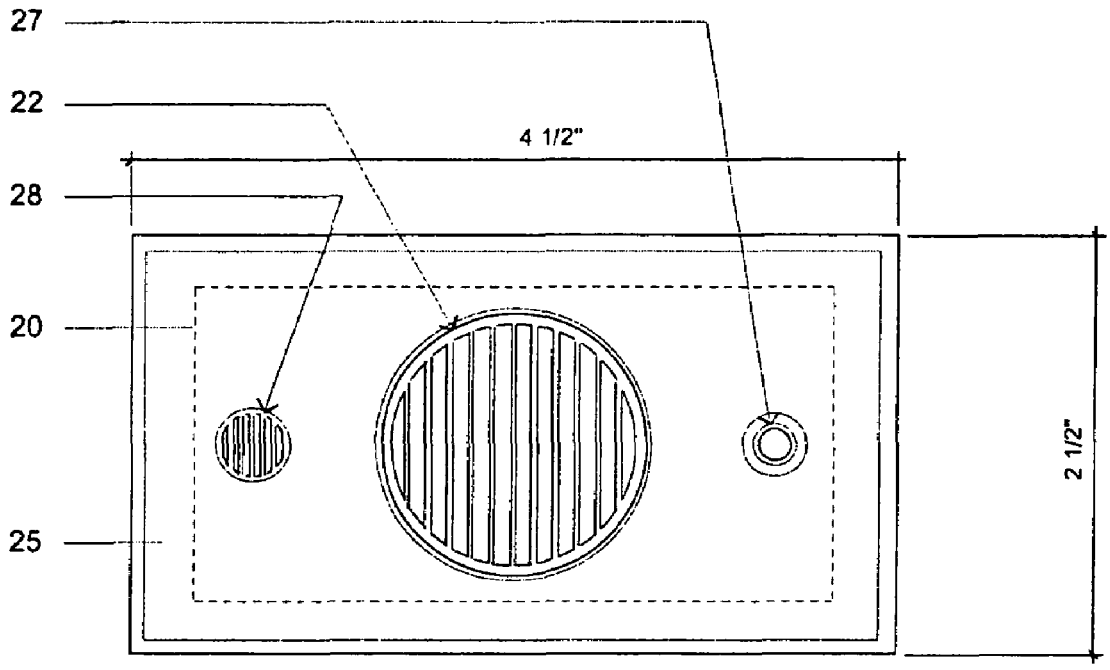
FIG. 3 is a plan view of the cover plate of the first embodiment.

FIG. 3 corresponds to FIG. 2(*c*), and is a plan view of the cover plate 25 of the first embodiment of the smoke detector assembly 20 of the present invention.

Figure 4:
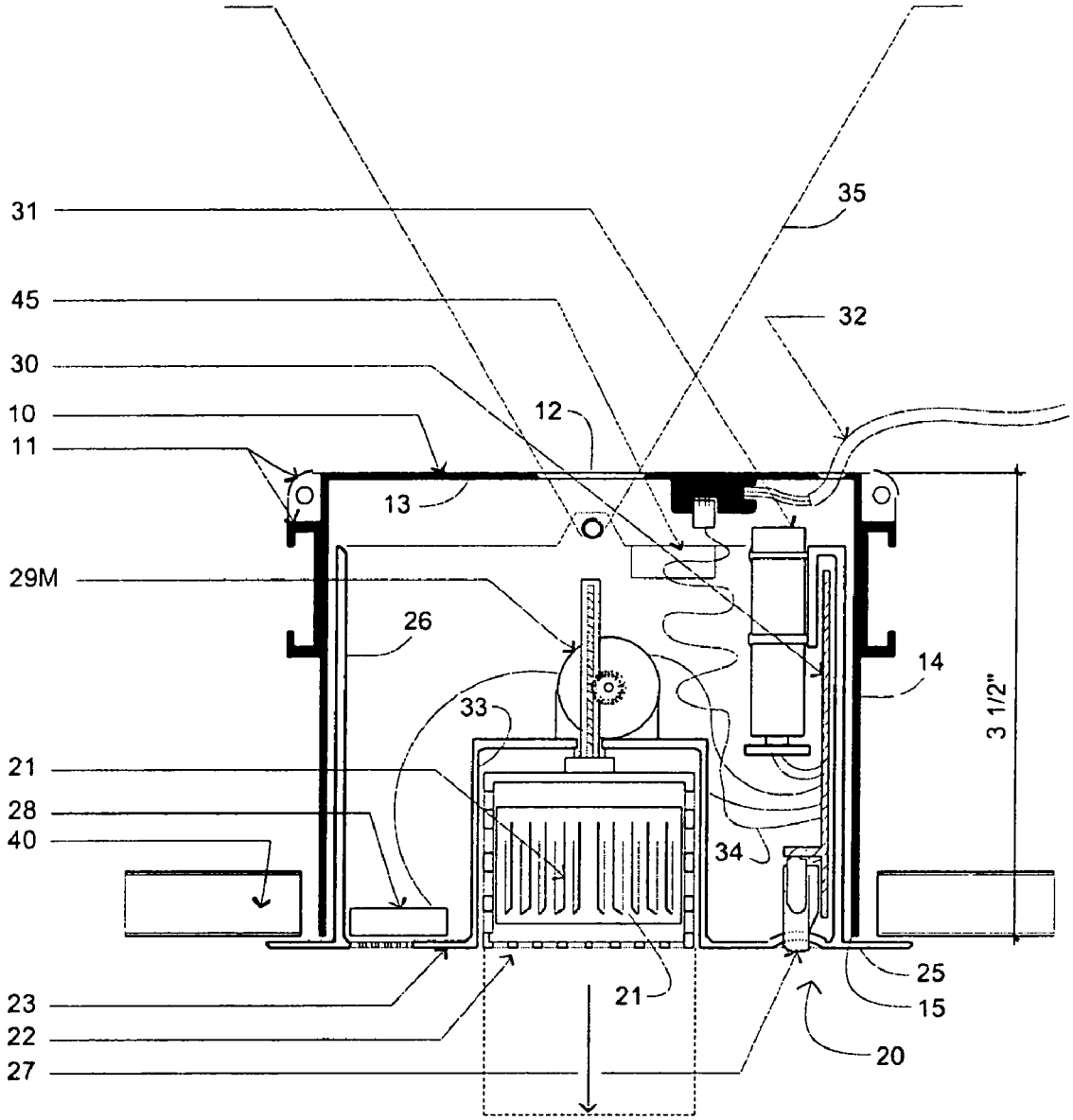
FIG. 4 is a cross-sectional side view of the recessed detector assembly of the first embodiment.

FIG. 4 shows shows a cross-sectional elevational view of the first embodiment of the smoke detector assembly 20, the first embodiment being having a drop down sensor housing 22. Sensor 21, held within the drop down housing 22, may be capable of detecting smoke, carbon monoxide, and/or other airborne substances, such as dust, chemical vapors, and other particles.

The mounting box 10 is a rectangular-shaped electrical wiring box to be used for new construction. Shown are mounting brackets 11 for either joist construction or suspended ceiling mounting, outer opening 15, side walls 14, inner wall 13, and wire prongs 35 passing through an inner opening 12 formed in the inner wall 13 of the box.

The smoke detector assembly 20, including sensor 21, is inserted into outer opening 15 of mounting box 10. The detector assembly 20 is provided with expandable wire prongs 35 that hold the detector assembly 20 in the wiring box 10. Thus, no tools are required to insert or remove the detector assembly from the wiring box 10. The assembly 20 includes a frame portion formed by the cover plate 25 and the side walls 26 projecting inward from the cover plate. A recess 33 is formed in the cover plate 25 providing a space for inserting/removing the smoke sensor 21. Openings 24 are formed at least on the exposed face of the sensor 21 so that smoke, carbon monoxide, and other airborne substances may enter the sensor 21. The cover plate 25 is flush mounted on the ceiling 40, and thus changes the appearance of the ceiling only minimally.

An electric motor 29M is mounted above the sensor 21. The motor 29M is powered by standard A/C power, but also is provided with a battery back-up 31 in the case of a power failure. A test button 27 and LED 27L are provided on the cover plate 25 on one side of the sensor, and an opening 23 for alarm 28 are provided on the cover plate 25 on the opposite side of the sensor 21.

A circuit board 30, containing the components and circuitry of the detector 21 is provided along one of the side walls 26 of the frame portion of the assembly 20. Electrical wiring connections 34 are provided to interconnect the alarm 28, motor 29M, the test button 27 and LED 27L, and battery 31 to the circuit board 30, and to the electrical power source 32 for the assembly. The power source 32 is typically 110 volts AC.

The detector assembly operates as follows: Smoke, other airborne substances, and heat may be produced by combustion in the vicinity of the detector assembly 20. Upon entering the openings 24 of the sensor 21, or when temperature rises above a predetermined level, a signal is generated to cause alarm 28 to issue an alarm sound (and/or a light signal) alerting persons in the room and/or building of an abnormal condition or incident. Simultaneously, or at a predetermined time thereafter, another signal is generated to turn on the motor 29M. Operation of the motor 29M has the effect of causing the smoke detector to drop down (as shown by the arrow), thus enabling the smoke-laden air within the sensor 21 to pass out through vents 21V, thus evacuating the smoke from the detector. As long as the air outside of the detector assembly is still smoke-laden, the sensor remains in the drop down position, and alarm 28 continues to operate. However, if the air outside of the detector assembly becomes free of the airborne substances, the airborne substance laden air inside the sensor 21 passes out through the vents 21V. Upon sensing clean air, a signal to the motor 29M causes the motor 29M to retract the drop down sensor 21 up into its original position in recess 33 of the detector assembly, and a signal to the alarm causes it to turn off. In other words, after the transient smoke has dissipated from the sensor 21, the sensor 21 is repositioned, reset, and ready to operate again when needed.

An optional transceiver 45 enables the one detector assembly to transmit a wireless signal to other detector assemblies or to a central control site, so that when one sensor 21 detects airborne substances and/or a high temperature, signals are transmitted to other locations to trigger alarms in other smoke detector assemblies, alert security personnel of a fire condition, or initiate other fire prevention actions.

Optionally, the drop down sensor of first embodiment may be operated (dropped down and retracted) by a solenoid instead of the electric motor 29M.

Figure 5:
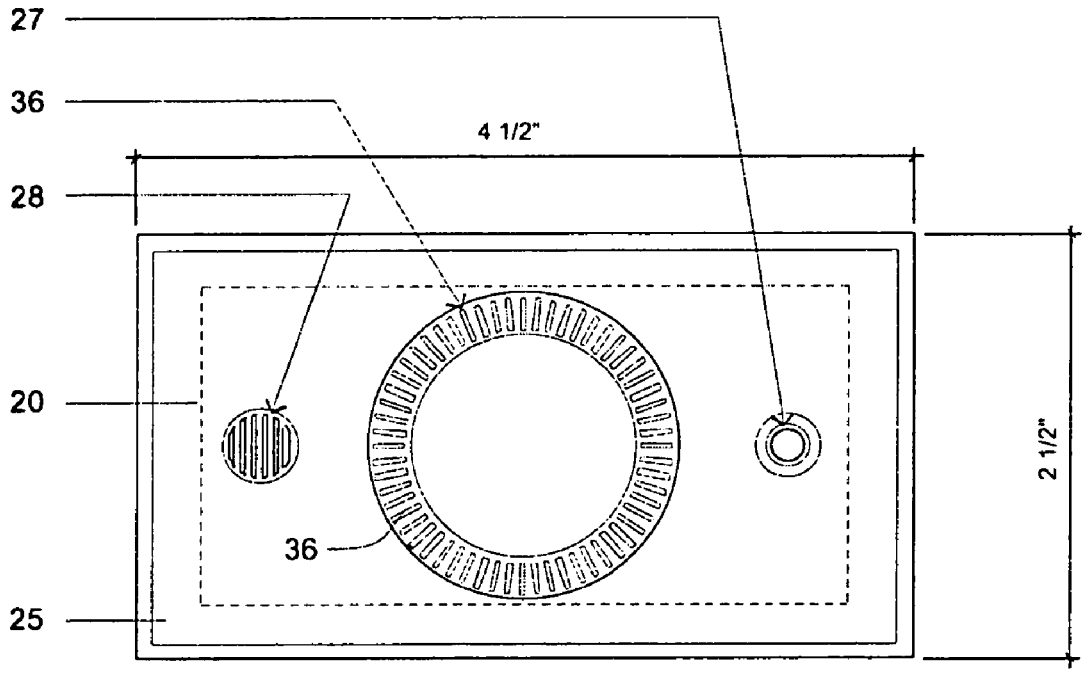
FIG. 5 is a plan view of the cover plate of the second embodiment.

FIG. 5 corresponds to FIG. 2(*d*), and is a plan view of cover plate 25 of the second embodiment of the recessed detector assembly of the present invention. This embodiment provides a sensor housing 36 projecting downward in a central portion of the cover plate 25. Sensor housing 36 is provided with a plurality of air vents 36V.

Figure 6:
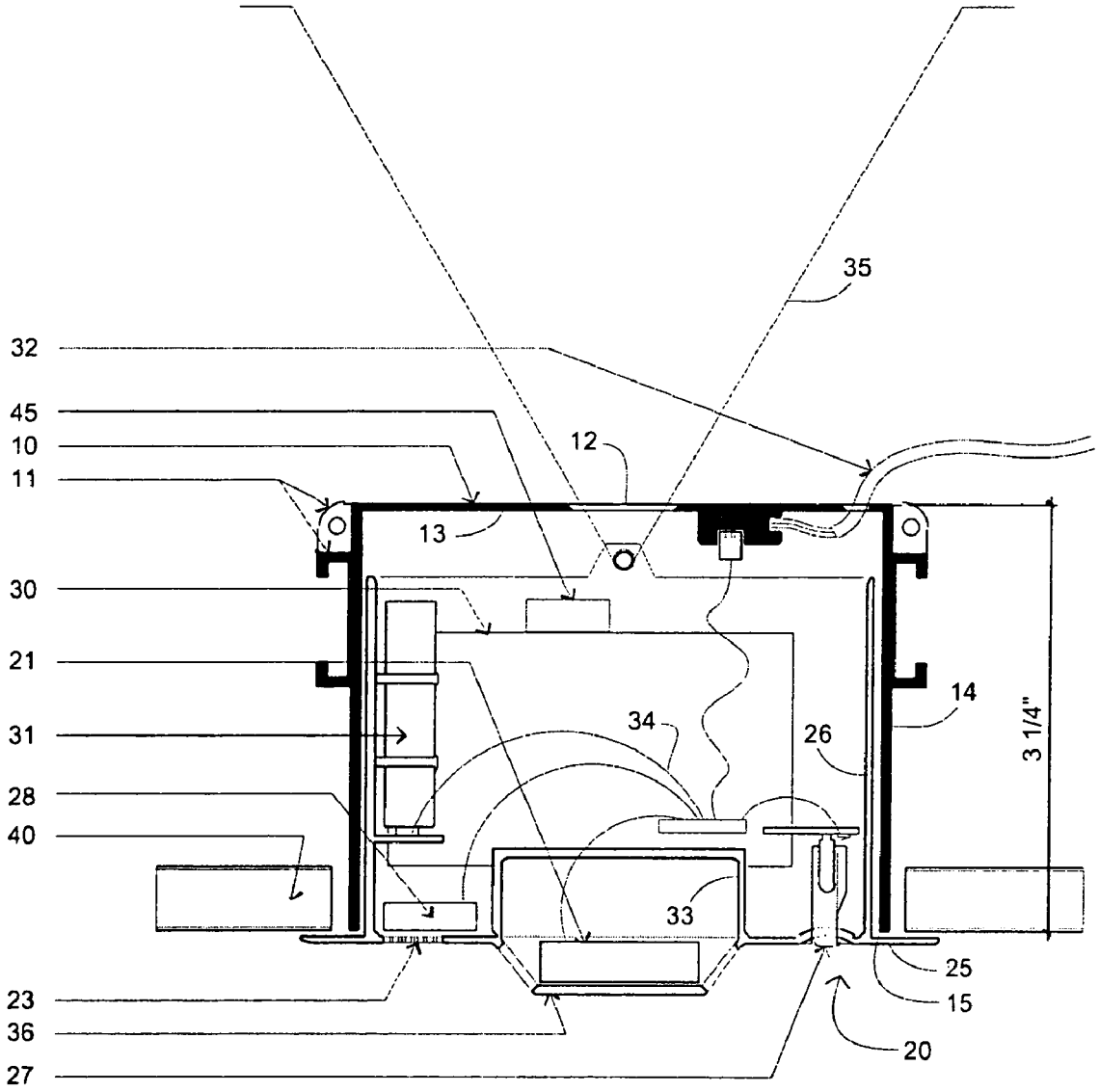
FIG. 6 is a cross-sectional side view of the recessed detector assembly of the second embodiment.

FIG. 6 shows a cross-sectional elevational view of the view of the second embodiment of the recessed detector assembly 20. Elements included in the second embodiment which are common with the first embodiment are not repeated here.

The second embodiment shown in FIG. 6 differs from the first embodiment in that sensor 21 is disposed in the downward projecting sensor housing 36, so that smoke laden air readily passes into and out of the vents 36V. Since the sensor 21 is always in a lowered position within the downward projected housing 36, and is always surrounded by the plurality of vents 36V, the motor 29M used the first embodiment may be eliminated. As soon as the air in the room becomes smoke free, the vents 36V provide for ready dispersal or evacuation of any remaining smoke-laden air which lingers in the sensor 21, and a signal turns off the alarm.

Figure 7:
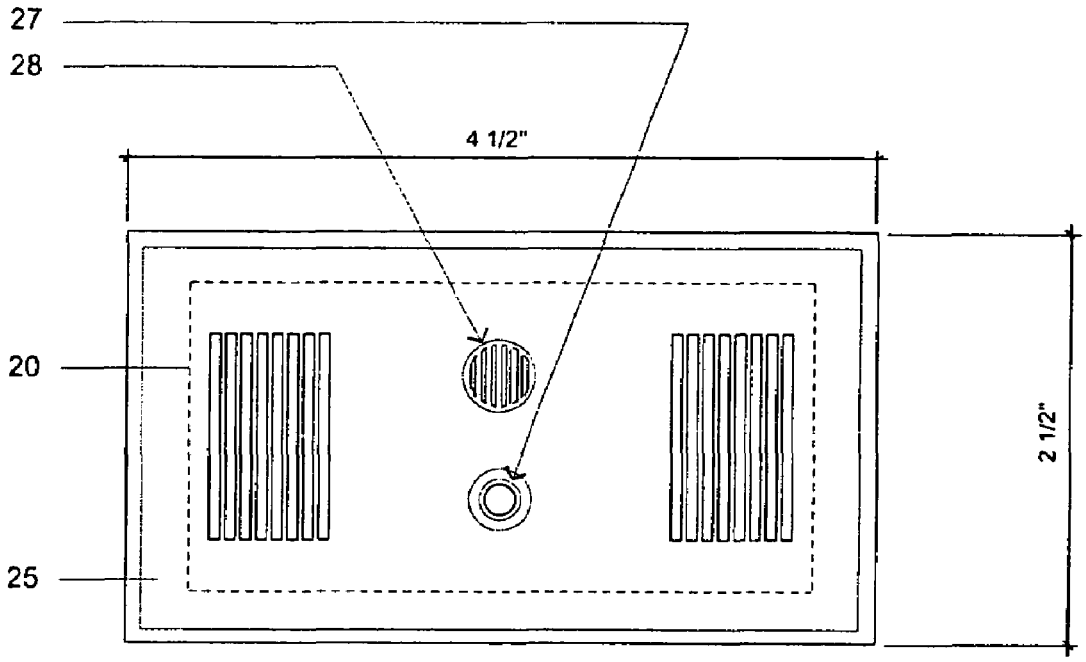
FIG. 7 is a plan view of the cover plate of the third embodiment.

FIG. 7 corresponds to FIG. 2(*e*), and is a plan view of cover plate 25 of the third embodiment of recessed detector assembly of the present invention.

Figure 8:
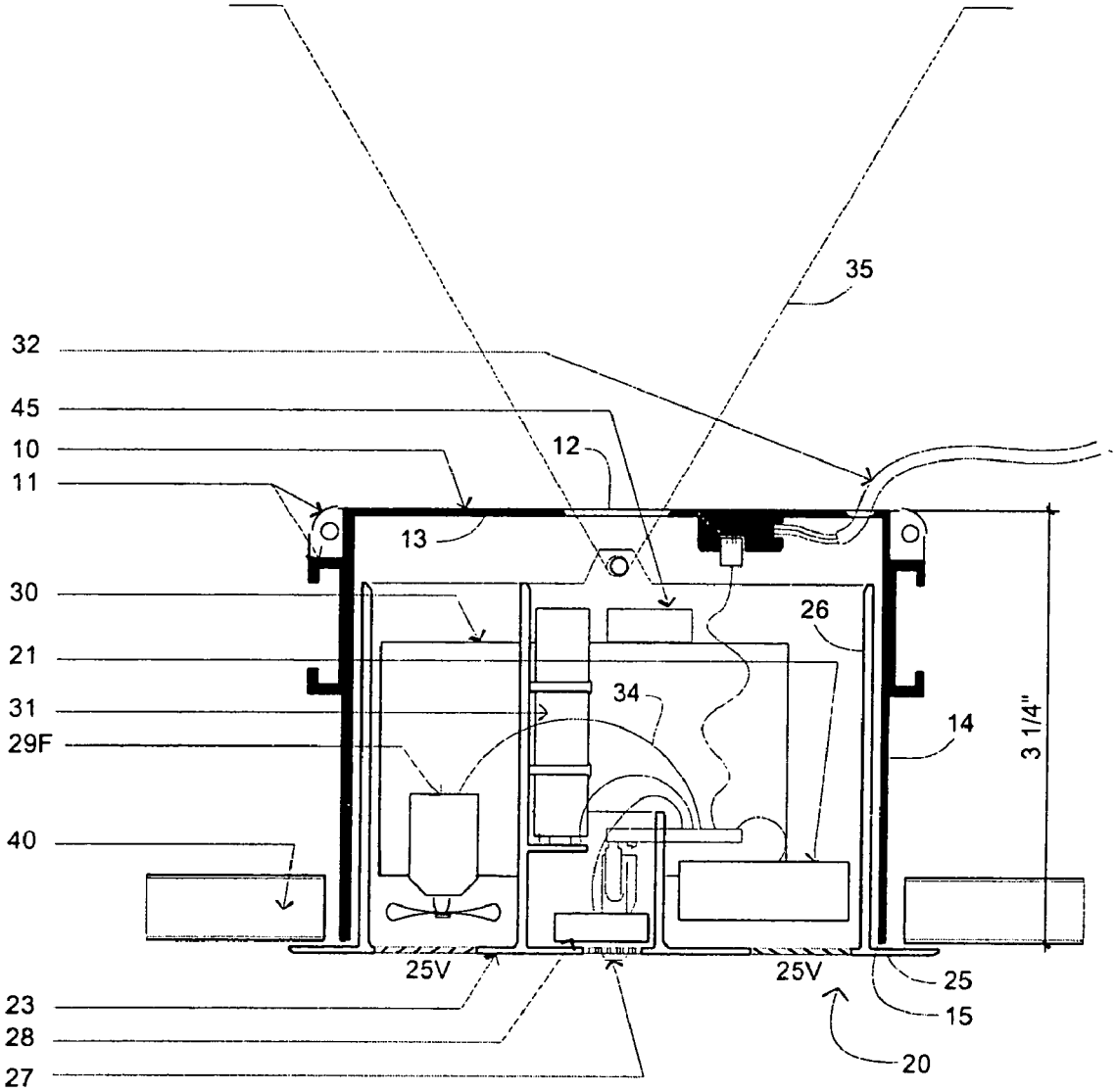
FIG. 8 is a cross-sectional side view of the recessed detector assembly of the third embodiment.

FIG. 8 shows shows a cross-sectional elevational view of the third embodiment of the smoke detector assembly 20. In this third embodiment an electric exhaust fan 29F is provided to positively evacuate airborne substances from within the detector assembly 20. Elements included in the third embodiment which are common with the first and the second embodiment are not repeated here. When smoke, carbon monoxide and/or other airborne substances are detected by sensor 21, a signal is sent to electric fan 29F. The fan 29F then operates so as to circulate air through air vents 25V in the cover plate 25. When the smoke-laden air has been evacuated from the smoke detector assembly 20, the electric fan 29F stops, and resets the unit.

Figure 9:
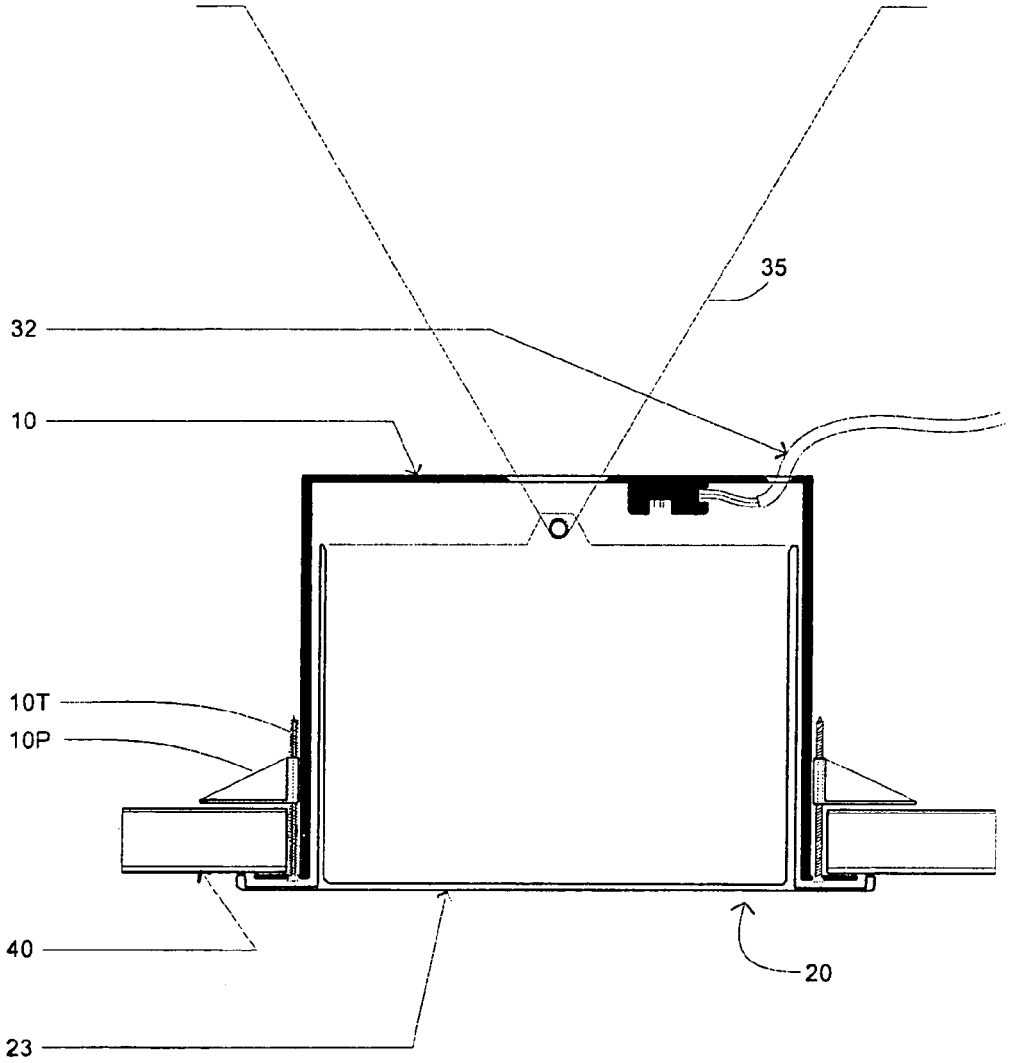
FIG. 9 is a cross sectional side view of the recessed detector assembly in an existing construction application as shown in FIG. 2(*b*)

FIG. 9 shows a cross-sectional view of the wiring box 10 for the detector assembly shown in FIG. 2(*b*). In particular, the wiring box 10 is designed for installation in an existing ceiling or wall, rather than new construction. As shown, wiring box 10 is provided with pivoting flanges 10*p*, and threaded members 10*t*, which hold the wiring box in place in an opening cut in the existing ceiling or wall.

Next the method of detecting airborne substance using the detector assembly of the present invention will be described with reference to FIG. 10.

Figure 10:
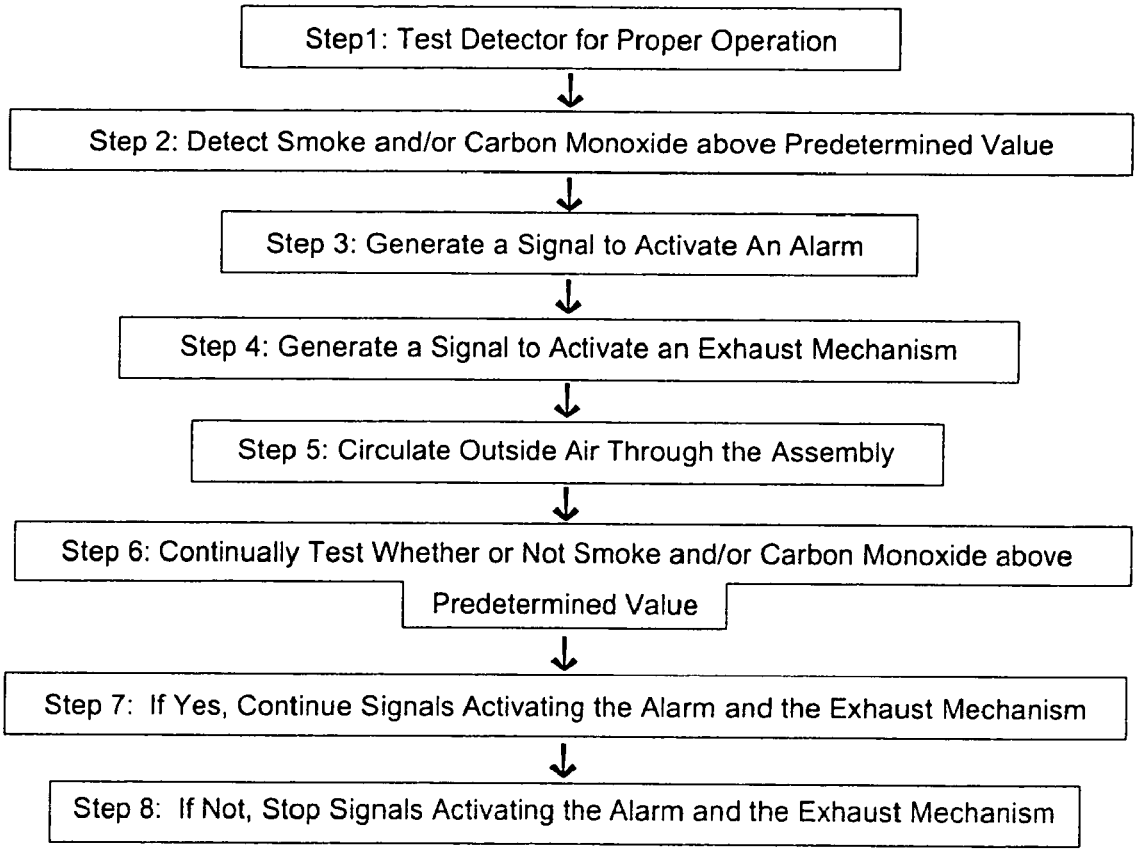
FIG. 10 shows the method of detecting smoke and/or airborne substances of the present invention.

FIG. 10 shows the steps of the method of detecting airborne substances using the detecting smoke detector assembly 20 of the present invention. The detector may be tested (Step 1) for proper operation at any time by pressing the test button 27. In Step 2, the detector senses when smoke and/or other airborne substances exceed predetermined value. When either the smoke and/or airborne substances exceed a predetermined value, and a signal is generated (Step 3) to activate alarm 28 simultaneously, or at a predetermined time thereafter, another signal is generated (Step 4) to activate the exhaust mechanism (for example, fan 29F or drop down sensor housing 22). The exhaust mechanism allows outside air to circulate (Step 5) through the detector assembly.

Meanwhile, sensor 21 continually tests (Step 6) whether or not either the smoke density or the density of other airborne substances remains above the predetermined values. If yes, the detector continues to generate signals (Step 7) activating the alarm 28 and the exhaust mechanism. If no, the detector stops sending signals to activate the alarm and the exhaust mechanism, and the detector is (Step 8).

Numerous positive effects result from the present invention. These include:

Unlike conventional recessed smoke detectors installed in walls or ceilings, the smoke detector is provided with means to exhaust air laden with smoke and/or other airborne substances from the detector, and thus the alarm is promptly shut off when the concentration of smoke and/or other airborne substances in the air drops below predetermined levels, and the detector is reset. Evacuation of smoke may be accomplished by initiating the action of a drop down sensor, or an exhaust fan, or by mounting the sensor in a downward projected housing with multiple vents for circulating air to and from the sensor.

The recessed wiring box allows for the installation of the smoke detector assembly flush to a ceiling or wall on both new and existing ceilings or walls. A single assembly can be equipped to sense smoke, carbon monoxide, and/or other airborne substances.

The wiring box includes two designs; one for new construction installation and one for existing construction.

The square or rectangular shape of the electric box allows for easy installation on adjacent ceiling materials.

The wiring box (for new construction) is easily installed and wired by the electrician during the pre-wiring of the building.

The new construction-wiring box has mounting brackets for both joist construction and suspended ceiling construction.

For existing walls and ceilings the wiring box includes threaded, pivoting support brackets.

The detector may also clip into a precut hole in wall or ceiling by means of spring-loaded clips on housing.

The wiring box may be designed to obtain "U.L." approvals.

The detector assemblies may be designed so that they can be interconnected with other detector assemblies throughout the building by wireless or wired means.

The wiring boxes are built to be used in fire-rated ceiling or wall assemblies.

The wiring boxes allow for the insertion or removal of the smoke detector assembly without the use of any tools.

The detector assemblies are flush with ceiling or wall except for the thickness of the detector cover plate (or smoke sensing element), and thus do not detract from the appearance of the ceiling or the wall.

The detector assemblies may have a set of expandable wire prongs to hold the detector in the wiring box, while allowing for removal with no tools.

The detector assemblies may be connected to the electrical source in the wiring box with a clip connection. Thus, no tools are required to connect or disconnect the electric from the detectors to the electrical source in the wiring box.

Once activated the detectors are designed to exhaust the smoke and/or other airborne substances out of the detector, thus allowing the detector to vent itself until no additional smoke from outside the detector is drawn into the detector, at which time the detector will shut off. The detectors have a recessed battery back-up power source, and have a visible power source light/test button.

The sensor or sensors in the assembly may be equipped to sense a wide variety of airborne substances, for example combustion products, such as smoke, carbon monoxide, etc., or to sense other elements in the air, including, but not limited to, chemical vapors, dust, and other particles. A sensor may also be provided to detect the temperature of the air in the assembly.

The face of detector assembly is designed be in various colors and finishes, and since it is flush with the wall or ceiling, it is esthetically desirable.

The detectors are designed so that smoke, carbon monoxide, or other airborne substances is evacuated from the detector by an internal exhaust fan that resets after a set period of time, or when smoke, carbon monoxide, or other airborne substances are no longer present. The detector automatically resets after airborne substances are cleared from the detector assembly.

In the drop down detector, the sensor drops down, exposing air vents on the sides of the sensor and allowing smoke and other airborne substances to escape through the air vents. The drop down action may be initiated by either a motor or a solenoid device. The exhaust fan and the drop down sensors are examples of active means for exhausting the air.

In addition to the active means for exhausting the assembly, passive means for exhausting are also provided. In Embodiment 2, for example, the detector is designed with a sensor in a projected sensor housing. Here, the multiple vents on the outer faces of the projected housing allow smoke and other airborne substances to escape easily, whereupon the sensor resets itself. Further, detector may be designed with vents in the inner side and upper portion of the wiring box allowing the smoke or other airborne substances to pass through the detector assembly into ceiling or wall cavity. Also, a separate ventilation device or system may be provided to exhaust the air in the wall or the ceiling.

In addition to the embodiments describe above, numerous other variations are to be considered within the scope of the present invention. For example:

The wiring box may be rectangular, square, or round in shape, and made of metal or plastic. The detector may be designed so that it can be automatically turned off and reset. Also, a test button is provided to allow testing of the unit at any time.

The alarm may provide either or both a sound alert as well as flashing light alert. In addition, the detector may be designed with sound alert and constant "ON" light to light up area below and in surrounding area.

The detector may be wired to transmit alarm signal to fire department or similar service, either by wireline or wireless transmission, or may activate an internal or external fire extinguishing apparatus when smoke or fire is detected.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A recessed detector assembly, comprising:

a detector frame adapted to be flush mounted into a mounting box mounted in a ceiling or a wall, the frame having exposed vents for allowing air containing airborne substances to enter the frame;

at least one sensor mounted in the detector frame for sensing one or more of the airborne substances;

means for exhausting the airborne substances, the at least one sensor generating a signal causing the means for exhausting the one or more airborne substances to operate when a presence of the one or more of the airborne substances is sensed to exceed predetermined levels, wherein the means for exhausting the airborne substances is a drop down sensor, the drop down sensor being provided with additional exposed vents.

2. The recessed detector assembly according to claim 1, further comprising a power-on indicator light and a test button.

3. The recessed detector assembly according to claim 1, further comprising a battery for powering the detector in the case of power failure.

4. The recessed detector assembly according to claim 1, wherein the sensor generates an alarm signal to activate an alarm when the one or more of the airborne substances is detected to exceed the predetermined values, the alarm signal stopping when presence of the airborne substances in the detector assembly is reduced below the predetermined levels.

5. The recessed detector assembly according to claim 1, when the vents are formed on a cover plate of the detector frame.

6. The recessed detector assembly according to claim 1, wherein the clips are provided to hold the detector assembly in the mounting box.

7. The recessed detector assembly according to claim 1, further comprising a cover plate formed with a substantially flat surface, the exposed vents being disposed on the flat surface.

8. The recessed detector assembly according to claim 1, wherein the at least one sensor generates an alarm signal when the presence of the one or more of the airborne substances exceeds the predetermined levels.

9. The recessed detector assembly according to claim 1, wherein the at least one sensor detects temperature of the assembly.

10. The recessed detector assembly according to claim 1, further comprising a transceiver for enabling the detector assembly to transmit an alarm to another detector assembly when the presence of the one or more of the airborne substances exceeds the predetermined levels.

11. The recessed detector assembly according to claim 1, further comprising inside vents provided on at least one inner wall of the mounting box for allowing air to circulate into the wall or the ceiling.

12. A recessed detector assembly comprising, a detector frame adapted to be flush mounted into a mounting box mounted in a ceiling or a wall, the frame having exposed vents for allowing air containing airborne substances to enter the frame;

at least one sensor mounted in the detector frame for sensing one or more of the airborne substances;

means for exhausting the airborne substances, the at least one sensor generating a signal causing the means for exhausting the one or more airborne substances to operate when a presence of the one or more of the airborne substances is sensed to exceed predetermined levels, wherein the means for exhausting the airborne substances include an exhaust fan mounted above at least one of the exposed vents.

13. The recessed detector assembly according to claim 12, wherein the means for exhausting the airborne substances stops operating when none of the airborne substances is sensed to exceed the predetermined levels.

14. A recessed detector assembly, comprising:

a detector frame adapted to be flush mounted into a mounting box mounted in a ceiling or a wall, the frame having exposed vents for allowing air containing airborne substances to enter the frame;

at least one sensor mounted in the detector frame for sensing one or more of the airborne substances, the at least one sensor generating a signal causing the means for exhausting the one or more airborne substances to operate when a presence of the one or more of the airborne substances is sensed to exceed predetermined levels, and further comprising:

a cover plate formed with a conical-shaped projected sensor housing, and the exposed vents being disposed on the conical-shaped projected housing, the exposed vents serving as means for exhausting the airborne substances.

15. A method for detecting airborne substances in a recessed detector assembly, comprising the steps of:

determining when airborne substances in a detector assembly reach a predetermined level;

generating a signal to activate a drop down sensor with exposed vents, the drop down sensor with exposed vents serving as an exhaust mechanism;

evacuating the airborne substances from the assembly; and stopping the signal activating the exhaust mechanism when the airborne substances have been reduced below the predetermined level.

16. The method for detecting airborne substances in a recessed detector assembly according to claim 15, further comprising the step of:

generating a signal to activate an alarm when the airborne substances in the detector assembly reach the predetermined level.

17. The method for detecting airborne substances in a recessed detector assembly according to claim 15, further comprising the step of:

stopping a signal to activate an alarm when the airborne substances in the detector assembly have been reduced below the predetermined level.

18. The method for detecting airborne substances in a recessed detector assembly according to claim 15, further comprising the step of generating an alarm when a temperature in the assembly exceeds a predetermined value.

* * * * *